US011391004B1

(12) United States Patent
Ye et al.

(10) Patent No.: US 11,391,004 B1
(45) Date of Patent: Jul. 19, 2022

(54) CONSTRUCTION METHOD FOR UPRIGHT LIFTING OF LARGE-TONNAGE BOX GIRDER TO BRIDGE, AND ERECTION METHOD FOR LARGE-TONNAGE BOX GIRDER

(71) Applicants: CHINA RAILWAY NO. 2 ENGINEERING GROUP CO., LTD., Chengdu (CN); XINYUN ENGINEERING COMPANY OF CHINA RAILWAY NO. 2 ENGINEERING GROUP CO., LTD., Chengdu (CN)

(72) Inventors: Yusen Ye, Chengdu (CN); Jiannan Chen, Chengdu (CN); Chuanwei Pan, Chengdu (CN); Guohui Lin, Chengdu (CN); Mengqiang Chen, Chengdu (CN); Shilong Li, Chengdu (CN); Chao Li, Chengdu (CN); Qiang Wang, Chengdu (CN); Jianjun Chen, Chengdu (CN); Da Li, Chengdu (CN); Haoxian Tang, Chengdu (CN)

(73) Assignees: China Railway No. 2 Engineering Group Co. LTD., Chengdu (CN); Xinyun Engineering Company of China Railway No. 2 Engineering Group, Co., LTD., Chengdu (CN)

( * ) Notice: Subject to any disclaimer, the term of this patent is extended or adjusted under 35 U.S.C. 154(b) by 0 days.

(21) Appl. No.: 17/613,060

(22) PCT Filed: May 15, 2020

(86) PCT No.: PCT/CN2020/090405

§ 371 (c)(1),
(2) Date: Nov. 20, 2021

(87) PCT Pub. No.: WO2020/233501

PCT Pub. Date: Nov. 26, 2020

(30) Foreign Application Priority Data

May 23, 2019 (CN) ..... 201910438594.7

(51) Int. Cl.
*E01D 21/00* (2006.01)
*E01D 21/06* (2006.01)
(Continued)

(52) U.S. Cl.
CPC ..... *E01D 21/06* (2013.01); *B66C 19/00* (2013.01); *E01D 2/04* (2013.01)

(58) Field of Classification Search
CPC ..... E01D 2/04; E01D 21/06; B66C 19/00
(Continued)

(56) References Cited

U.S. PATENT DOCUMENTS 5,940,916 A 8/1999 Muller
7,520,014 B2 * 4/2009 Homsi ..... E01D 2/02 14/77.3
(Continued)

FOREIGN PATENT DOCUMENTS

CN 101139821 A 3/2008
CN 101818480 A 9/2010
(Continued)

OTHER PUBLICATIONS

Linlu, KE; "Comparison and selection of precast beam site scheme of Ningde super large bridge on new railway Wenfu line;" Science and Technology Information; Mar. 5, 2009; Issue 3, pp. 224-226; China Academic Journal Publishing House; www.cnki.net.

*Primary Examiner* — Raymond W Addie
(74) *Attorney, Agent, or Firm* — Andrew D. Fortney; Central California IP Group, P.C.

(57) ABSTRACT

A construction method for the upright lifting of a large-tonnage box girder to a bridge, and an erection method for
(Continued)

the large-tonnage box girder. The construction method comprises: constructing a lifting station (2) at reserved bridge piers (1); disposing a girder lifting base (3), lifter traveling rails (4), and a mounting lifter (6) in the lifting station (2); directly erecting a box girder (7) by the lifter (6) in a way that the lifter (6) travels to a position above the base (3) and erects the box girder (7). The erection method further comprises: lifting by the lifter (6) a single set of transport and erection apparatuses or two sets of transport and erection apparatuses to a bridge, a girder transport vehicle (9) cooperating with a bridge erecting machine (10) to repeatedly complete the erection of the box girder (7); hoisting by the lifter (6) the transport and erection apparatus off the bridge; lifting by the lifter (6) the box girder (7) within the scope of the reserved bridge pier (1) to the erected box girder (7); and constructing the reserved bridge piers (1); completing by the lifter (6) the erection of the box girder (7) within the scope of the reserved bridge piers (1). The construction and erection methods for the box girder occupy a small space and have high efficiency.

2 Claims, 13 Drawing Sheets

(51) Int. Cl.
*B66C 19/00* (2006.01)
*E01D 2/04* (2006.01)

(58) Field of Classification Search
USPC ..... 14/77.1
See application file for complete search history.

(56) References Cited

U.S. PATENT DOCUMENTS

| | | | | |
|---|---|---|---|---|
| 9,163,367 | B2 * | 10/2015 | Carney | B66C 17/20 |
| 2014/0251936 | A1 * | 9/2014 | Carney | B66C 19/02 212/294 |
| 2019/0016568 | A1 * | 1/2019 | Pan | B66C 17/20 |

FOREIGN PATENT DOCUMENTS

| | | | |
|---|---|---|---|
| CN | 102071646 | A | 5/2011 |
| CN | 102182147 | A | 9/2011 |
| CN | 102493352 | A | 6/2012 |
| CN | 103132459 | A | 6/2013 |
| CN | 104400309 | A | 3/2015 |
| CN | 104532755 | A | 4/2015 |
| CN | 104631335 | A | 5/2015 |
| CN | 106087774 | A | 11/2016 |
| CN | 106567342 | A | 4/2017 |
| CN | 207143706 | U | 3/2018 |
| CN | 208884372 | U | 5/2019 |
| CN | 110055902 | A | 7/2019 |
| JP | 2008297777 | A | 12/2008 |
| JP | 2013142226 | A | 7/2013 |
| JP | 2014066007 | A | 4/2014 |
| KR | 20030093680 | A | 12/2003 |

* cited by examiner

CONSTRUCTION METHOD FOR UPRIGHT LIFTING OF LARGE-TONNAGE BOX GIRDER TO BRIDGE, AND ERECTION METHOD FOR LARGE-TONNAGE BOX GIRDER

This application claims the benefit of Chinese Patent Application No. 201910438594.7, filed May 23, 2019, incorporated herein by reference in its entirety.

TECHNICAL FIELD

The invention relates to the technical field of bridge engineering, in particular to a construction method for upright lifting of a large-tonnage box girder to a bridge, and an erection method for the large-tonnage box girder.

BACKGROUND ART

According to a traditional construction method for upright lifting of a large-tonnage reinforced concrete precast box girder, the method comprises the following steps that firstly, a temporary road to a bridge is filled, and a girder conveying apparatus runs from a girder fabrication yard for taking the girder to a bridge floor along the temporary road; secondly, a special lifting station is arranged, and a transport and erection apparatus is lifted at a side position and the reinforced concrete precast box girder is lifted to the bridge by a large-span lifter.

The method for filling the temporary road to the bridge has the following defects that: the temporary road must be led out from the middle line of the bridge, which affects the construction of adjacent sections; the bridge floor is large in height difference from the ground, the temporary road is set to be fairly long as limited by climbing capacity of the girder conveying apparatus, and it has a large temporary engineering quantity and a high cost; a special apparatus is required to be arranged in the prefabrication field for taking the girder; it is very difficult to build the road on the soft soil foundation in the mud flat area, and the recovery cost is very high after the project is finished. The lifting of the apparatus at a side position by the lifting station and the girder to the bridge has the following defects that the required girder lifting apparatus has a large span, a huge land use area and high use risks.

SUMMARY OF THE INVENTION

The invention is directed to overcome the defects in the prior art, and provides a construction method for the upright lifting of a large-tonnage box girder to a bridge, and an erection method for the large-tonnage box girder.

In order to achieve the purpose, the invention provides the following technical solutions. The invention discloses a construction method for the upright lifting of a large-tonnage box girder to a bridge, which comprises the following steps:

S1: constructing a lifting station;

reserving a plurality of bridge piers on a bridge line for temporary non-construction, constructing a lifting station at reserved bridge piers, arranging a plurality of girder lifting bases in the lifting station, and constructing lifter traveling rails and installing lifters on both sides of the bridge piers along the longitudinal center lines of the bridge piers;

S2: directly erecting a box girder by the lifter;

S21: transporting by a transporter the box girder to be erected to the girder lifting base for storage;

S22: causing the lifter to travel directly above the girder lifting base and lifting the box girder to be erected to the height of the bridge floor; and S23: longitudinally moving the lifter to a position of the bridge span to be erected and erecting the box girder to be erected.

In the prior art, a lifting station is arranged on one side of a bridge line, a box girder is lifted by a lifter at a side position, and then transversely moved to the bridge (simply referred to as a side lifting of the girder); however, in the present application, the lifting station is directly arranged below the bridge line, the lifter traveling rail is adjacent to the bridge line and arranged on both sides of a bridge pier, the box girder to be erected is directly arranged below the line, and is directly lifted by the lifter to the bridge (simply referred to as upright lifting of the girder). Therefore, compared with the side lifting of the girder, the lifting station is directly arranged below the bridge line by the upright lifting of the girder, the land use area is greatly saved, the lifter traveling rail can be directly arranged close to the bridge line, the span of the lifter can be greatly reduced, and the stability of apparatus is facilitated.

According to the construction method for the upright lifting of a large-tonnage box girder to a bridge, a small-span apparatus is used for replacing a large-span apparatus to complete construction operation, and a girder lifting station is arranged on the longitudinal center line of the bridge pier, so that the land use area is saved, the construction cost is reduced, the stability of the apparatus is facilitated, the use risk of the apparatus is reduced, and the operation efficiency is improved.

Preferably, in the step S1, the span center line of the lifting station coincides with the center line of the bridge pier, and the girder lifting base is arranged in the middle of the lifting station.

Preferably, in the step S1, the coverage range of the lifter traveling rail at least comprises three front and rear bridges of the lifting station so as to ensure that the lifter can erect the box girders on both sides of the lifting station.

Preferably, in the step S1, the number of the reserved bridge piers depends on the external size of a transport and erection apparatus, so that the transport and erection apparatus can smoothly move to the bridge by the lifter.

Preferably, it further comprises the following steps after the step S23:

S24: repeating the steps S21 to S23, erecting a next box girder to be erected until the total size of the box girders directly erected by a girder lifting machine is larger than the external size of the transport and erection apparatus;

it further comprises the following steps after the step 24:

S3: lifting by the lifter the transport and erection apparatus to the bridge;

S31: transporting by a girder transport vehicle a bridge erecting machine to a lifting station;

S32: respectively lifting by the lifter the bridge erecting machine and the girder transport vehicle to the bridge, and placing the box girder erected in the step S2;

S4: lifting by the lifter the box girder to the bridge;

S41: transporting by a transporter the box girder to be erected to the girder lifting base for storage;

S42: causing the lifter to travel directly above the girder lifting base and lifting the box girder to be erected to the height of the vehicle loading;

S43: longitudinally moving the lifter to be directly above the girder transport vehicle, and placing the box girder to be erected on the girder transport vehicle.

According to the invention, the girder lifting machine is used for lifting the transport and erection apparatus to the bridge, the girder lifting machine cooperates with the transport and erection apparatus for use, and the box girders lifted by the girder lifting machine are conveyed to the front for operation by the girder transport vehicle, so that the box girders of the whole bridge can be moved to the bridge.

Preferably, in the step S3, the center line of the girder transport vehicle is adjusted by using a slanted traveling function of the girder transport vehicle, so that the center line of the girder transport vehicle and the center line of the bridge line substantially coincide.

The invention also discloses an erection method for a large-tonnage box girder, which comprises the following steps of:

S1: constructing a lifting station;

reserving a plurality of bridge piers on a bridge line for temporary non-construction, constructing a lifting station at reserved bridge piers, arranging a plurality of girder lifting bases in the lifting station, and constructing lifter traveling rails and installing lifters on both sides of the bridge piers along the longitudinal center lines of the bridge piers;

S2: directly erecting a box girder by the lifter;

S21: transporting by a transporter the box girder to be erected to the girder lifting base for storage;

S22: causing the lifter to travel directly above the girder lifting base and lifting the box girder to be erected to the height of the bridge floor; and S23: longitudinally moving the lifter to a position of the bridge span to be erected and erecting the box girder to be erected;

S24: repeating the steps S21 to S23, erecting a next box girder to be erected until the total size of the box girders directly erected by the lifter is larger than the external size of the transport and erection apparatus;

S3: lifting by the lifter the transport and erection apparatus to the bridge;

S31: transporting by a girder transport vehicle a bridge erecting machine to a lifting station;

S32: respectively lifting by the lifter the bridge erecting machine and the girder transport vehicle to the bridge, and placing the box girder erected in the step S2;

S4: lifting by the lifter the box girder to the bridge;

S41: transporting by a transporter the box girder to be erected to the girder lifting base for storage;

S42: causing the lifter to travel directly above the girder lifting base and lifting the box girder to be erected to the height of the vehicle loading;

S43: longitudinally moving the lifter to be directly above the girder transport vehicle, and placing the box girder to be erected on the girder transport vehicle;

S5: causing the girder transport vehicle to cooperate with the bridge erecting machine to complete the erection of the box girder;

longitudinally moving the bridge erecting machine to a position of the bridge span to be erected, transporting by the girder transport vehicle the box girder to be erected to the bridge erecting machine, and causing the girder transport vehicle to cooperate with the bridge erecting machine to complete the erection of the box girder;

S6: repeating the steps S4 to S5, and erecting the next box girder to be erected until the erection of all the box girders in the same direction is completed;

S7: hoisting by the lifter the transport and erection apparatus off the bridge;

S71: transporting by the girder transport vehicle the bridge erecting machine to the box girder near the lifting station;

S72: respectively hoisting by the lifter the bridge erecting machine and the girder transport vehicle off the bridge;

S8: turning the bridge erecting machine and the girder transport vehicle under the bridge;

S9: repeating the steps S2-S7, completing the erection of all box girders in the other direction, and hoisting the transport and erection apparatus off the bridge;

S10: lifting by the lifter all the box girders to be erected in the range of the reserved bridge piers to the bridge, and simultaneously placing the box girders to be erected on the erected box girders;

S11: constructing the reserved bridge piers;

S12: directly erecting by the lifter the box girders to be erected within the range of the reserved bridge piers to a position of the bridge span to be erected, thereby completing the erection construction of the large-tonnage box girders for the whole bridge.

According to the erection method for a large-tonnage box girder, the erection construction for the large-tonnage box girders of the whole bridge is completed by adopting the construction method for the upright lifting of a large-tonnage box girder to a bridge and combining a bridge erecting machine and a girder transport vehicle, so that the installation and disassembly of apparatus are facilitated, the occupied area of the lifting station is reduced, and the construction cost is reduced.

Preferably, the step S2 comprises erecting by the lifter the box girders in both directions of the bridge, wherein a plurality of box girders are arranged on both sides of the lifting station, and the total size of the box girders directly erected by the lifter in each direction is larger than the external size of the transport and erection apparatus;

the step S3 comprises lifting by the lifter two sets of transport and erection apparatuses to the box girders in both directions;

the step S4 comprises respectively placing the box girders lifted by the lifter on two girder transport vehicles in different directions;

the step S5 comprises causing the girder transport vehicle in each direction to cooperate with the corresponding bridge erecting machine to complete box girder erection;

the step S6 comprises repeating the steps S4 to S5, and erecting the next box girder to be erected until the erection of all the box girders in the both directions is completed; and the step S7 comprises hoisting by the two sets of transport and erection apparatuses off the bridge, wherein the steps S8 and S9 are omitted.

The erection construction of the box girders in both directions (large mileage and small mileage) of the bridge is simultaneously performed by using two sets of transport and erection apparatuses, so that the operation efficiency can be greatly improved, and the construction time can be saved.

Compared with the prior art, the invention has the following beneficial effects.

(1) The installation and disassembly of apparatus are facilitated, the occupied area of the lifting station is reduced, and the construction cost is reduced.

(2) The span of the apparatus is reduced, the weight of the whole machine is reduced, and the apparatus purchase cost is reduced.

(3) The stability of the apparatus is facilitated, the use risk of the apparatus is reduced, and the operation efficiency is improved.

Figure 1:
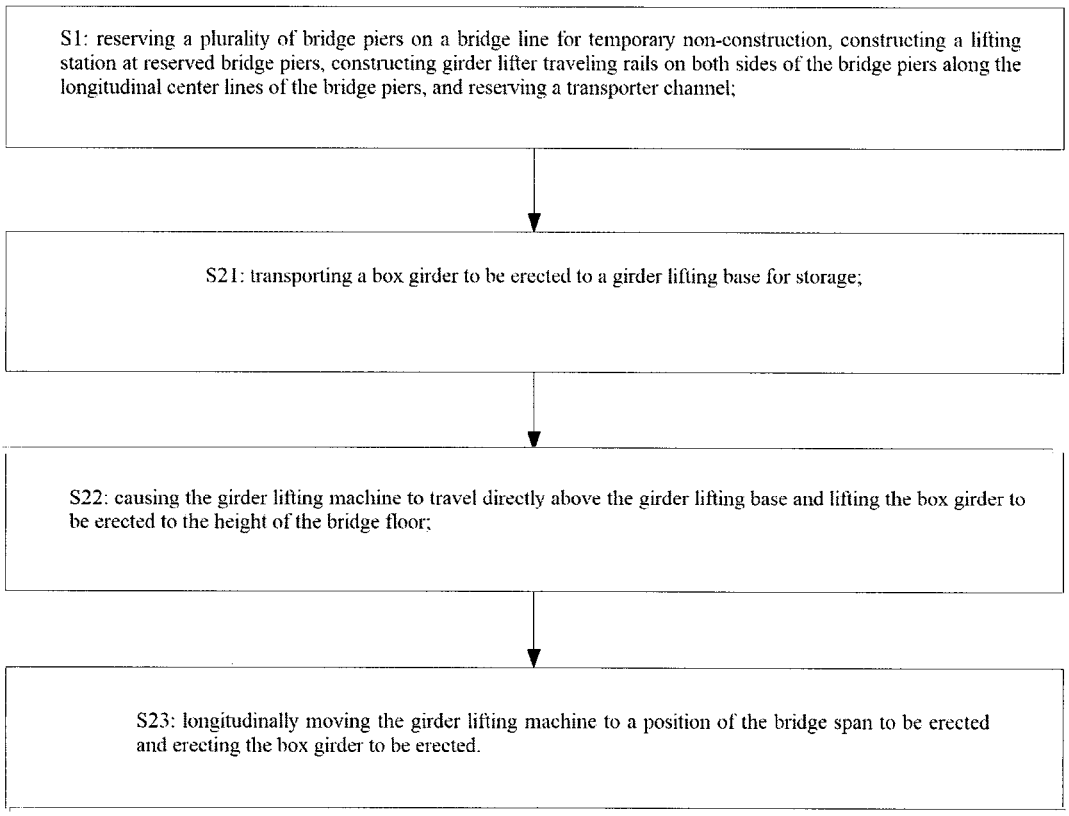
FIG. 1 is a flow diagram of a construction method for upright lifting of a large-tonnage box girder to a bridge according to Embodiment 1 of the invention.

Reference numerals: 1-bridge pier, 2-lifting station, 3-girder lifting base, 4-lifter traveling rail, 5-transporter channel, 6-lifter, 7-box girder to be erected, 8-erected box girder, 9-girder transport vehicle, and 10-bridge erecting machine.

DETAILED DESCRIPTION

The present invention will now be described in further detail with reference to experimental examples and specific embodiments. However, it should not be understood that the scope of the above-described subject matter of the present invention is limited to the following embodiments, and the technology implemented based on the disclosure is within the scope of the present invention.

Embodiment 1

Figure 2:
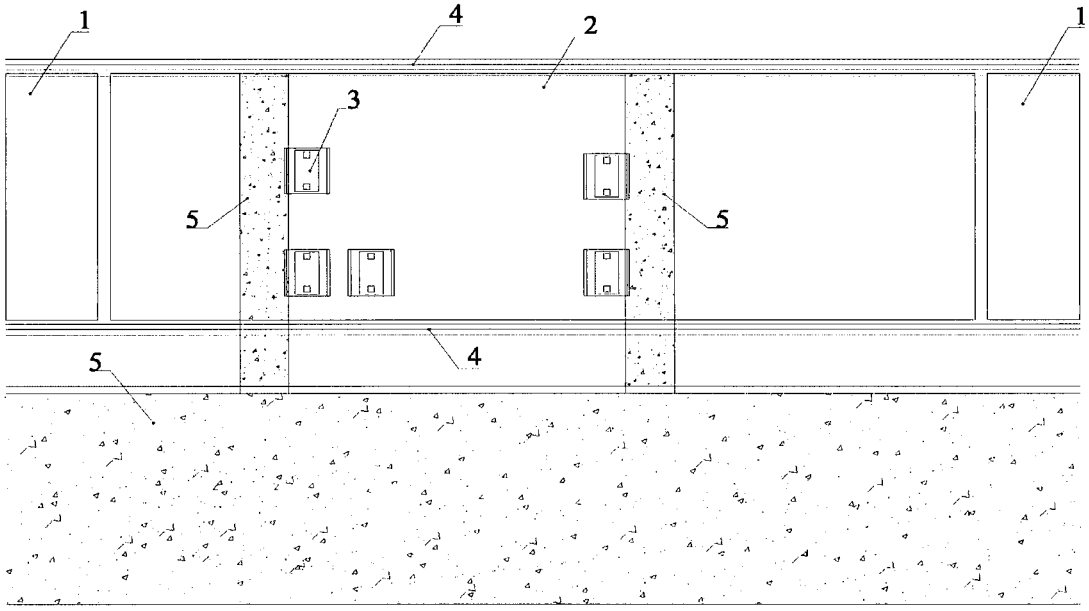
FIG. 2 is a structurally schematic view of the lifting station according to the present invention.

As shown in FIG. 1, a construction method for the upright lifting of a large-tonnage box girder to a bridge comprises the following steps:

S1: Constructing a Lifting Station 2;

As shown in FIG. 2, a plurality of bridge piers 1 are reserved on a bridge line for temporary non-construction, a lifting station 2 is constructed at the reserved bridge piers 1, and the center line of the span of the lifting station 2 coincides with the center line of M-shaped bridge piers 1. A plurality of girder lifting bases 3 are arranged in the lifting station 2, and the girder lifting bases 3 are arranged in the middle of the lifting station 2 and are positioned right below the bridge line. An lifter traveling rail 4 is constructed on both sides of the bridge pier 1 along the longitudinal center line of the bridge pier 1, the coverage range of the lifter traveling rail 4 at least comprises three front and rear bridges of the lifting station 2, and an lifter is installed on the lifter traveling rail 4. A transporter channel 5 is reserved and constructed near the lifting station 2 for the transporter to travel.

Figure 3:
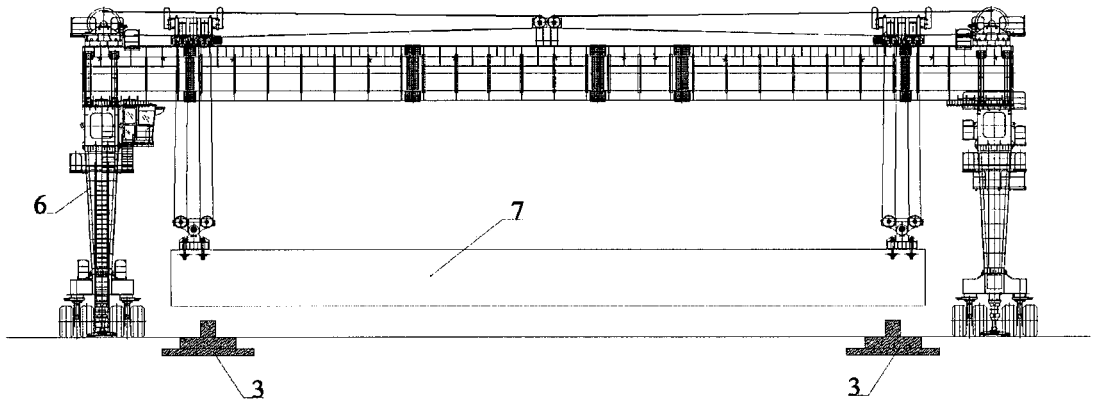
FIG. 3 is a schematic view for transporting by a transporter a box girder to be erected to a girder lifting base for storage according to the invention.
Figure 4:
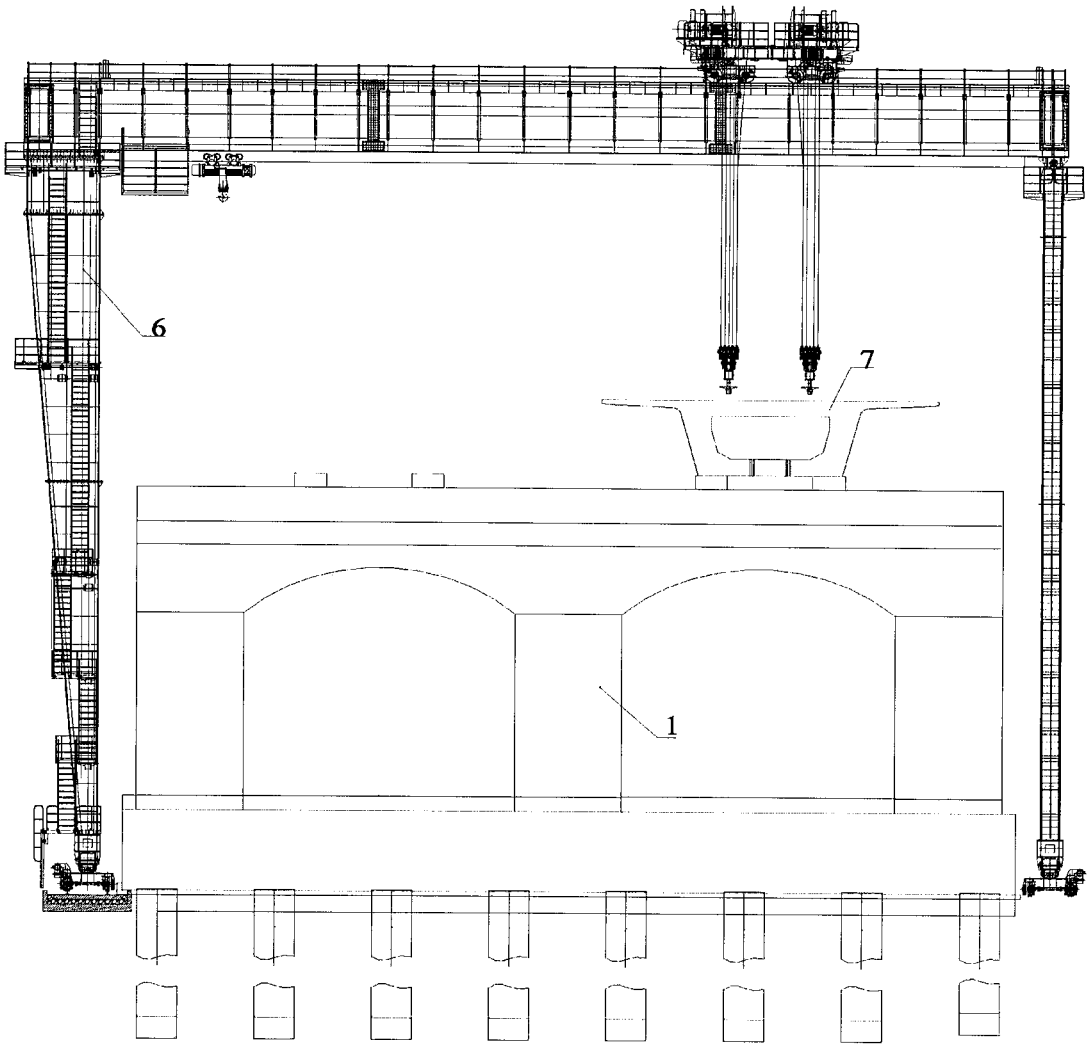
FIG. 4 is a schematic view of the lifter traveling directly above the girder lifting base and lifting the box girder to be erected to the height of the bridge floor according to the invention.
Figure 5:
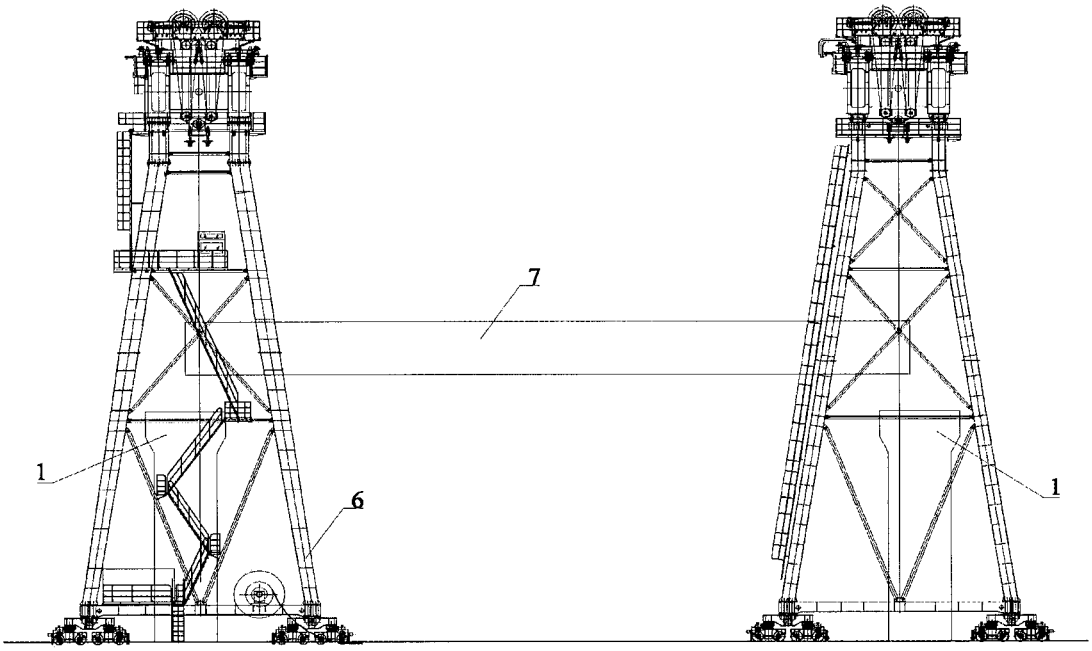
FIG. 5 is a schematic view of longitudinally moving the lifter to a position of a bridge span to be erected and erecting the box girder to be erected according to the invention.

S2: directly erecting a box girder by the lifter 6;

S21: transporting by a transporter the box girder 7 to be erected to the girder lifting base 3 for storage, as shown in FIG. 3;

S22: causing the lifter 6 to travel directly above the girder lifting base 3 and lifting the box girder 7 to be erected to the height of the bridge floor, as shown in FIG. 4;

S23: longitudinally moving the lifter 6 to a position of the bridge span to be erected and erecting the box girder 7 to be erected, as shown in FIG. 5.

Embodiment 2

Figure 6:
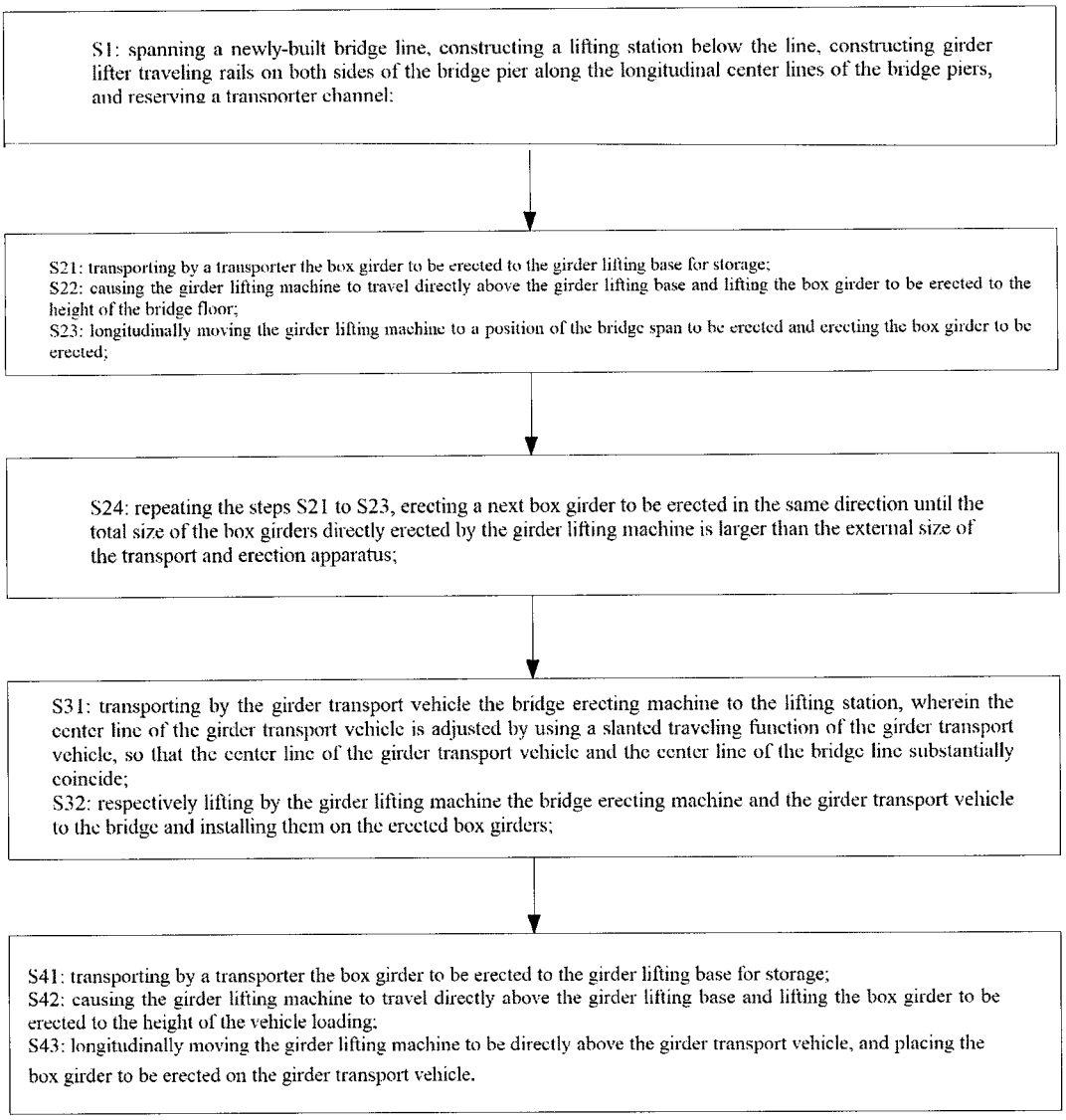
FIG. 6 is a flow diagram of a construction method for upright lifting of a large-tonnage box girder to a bridge according to Embodiment 2 of the invention.

As shown in FIG. 6, the embodiment discloses a construction method for the upright lifting of a large-tonnage box girder to a bridge, the construction steps of the construction method comprise all the steps of embodiment 1, and after the step S23, the construction method further comprises:

S24: repeating the steps S21 to S23, erecting a next box girder 7 to be erected in the same direction until the total size of the box girders directly erected by the lifter 6 is larger than the external size of the transport and erection apparatus, wherein the external size of the transport and erection apparatus comprises the length and the width of the bridge erecting machine and the girder transport vehicle.

Figure 7:
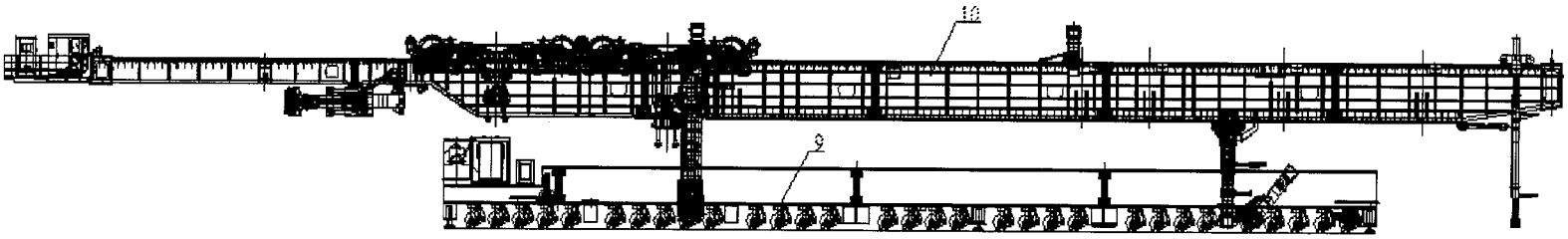
FIG. 7 is a schematic view of transporting by a girder transport vehicle a bridge erecting machine to a lifting station according to the invention.
Figure 8:
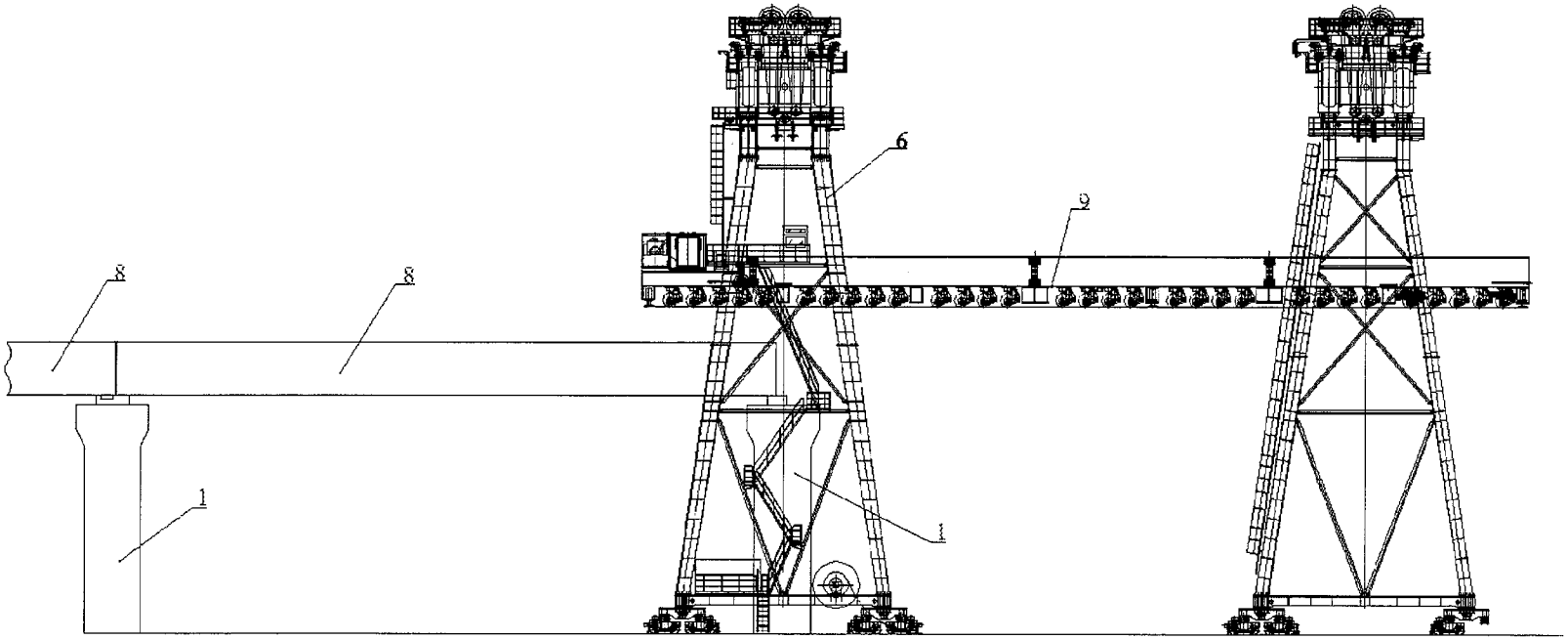
FIG. 8 is a schematic view of lifting by the lifter the girder transport vehicle according to the invention.
Figure 9:
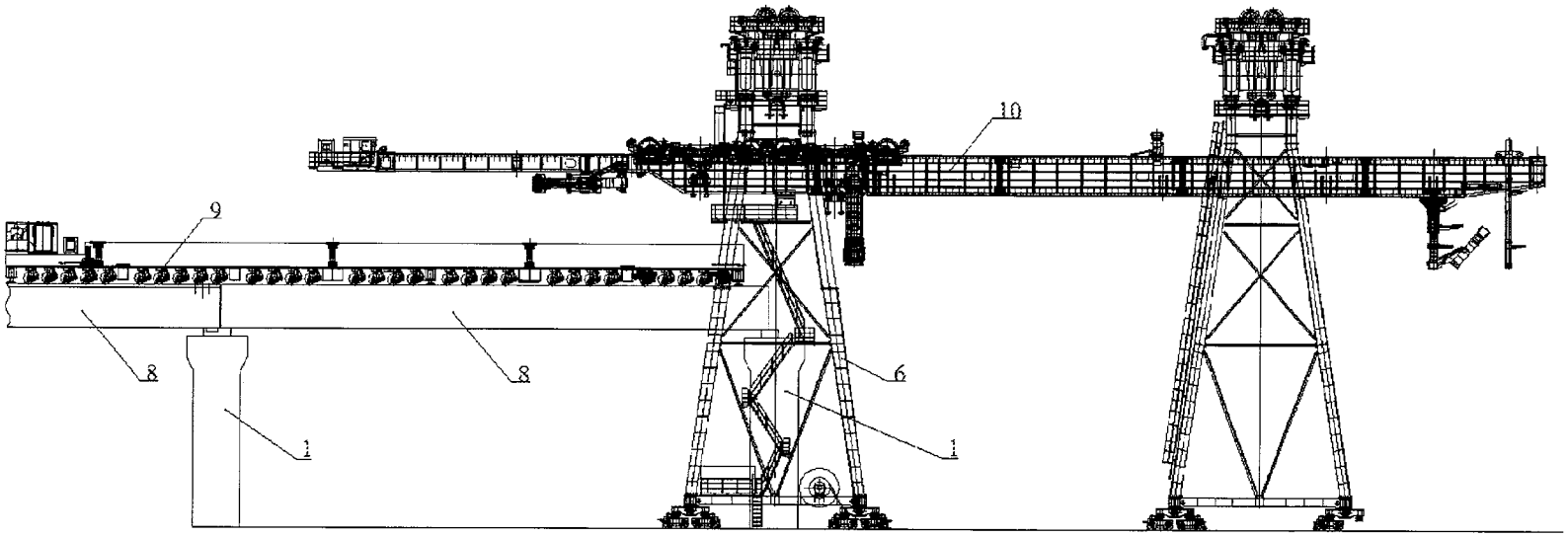
FIG. 9 is a schematic view of lifting the bridge erecting machine by the lifter according to the present invention.
Figure 10:
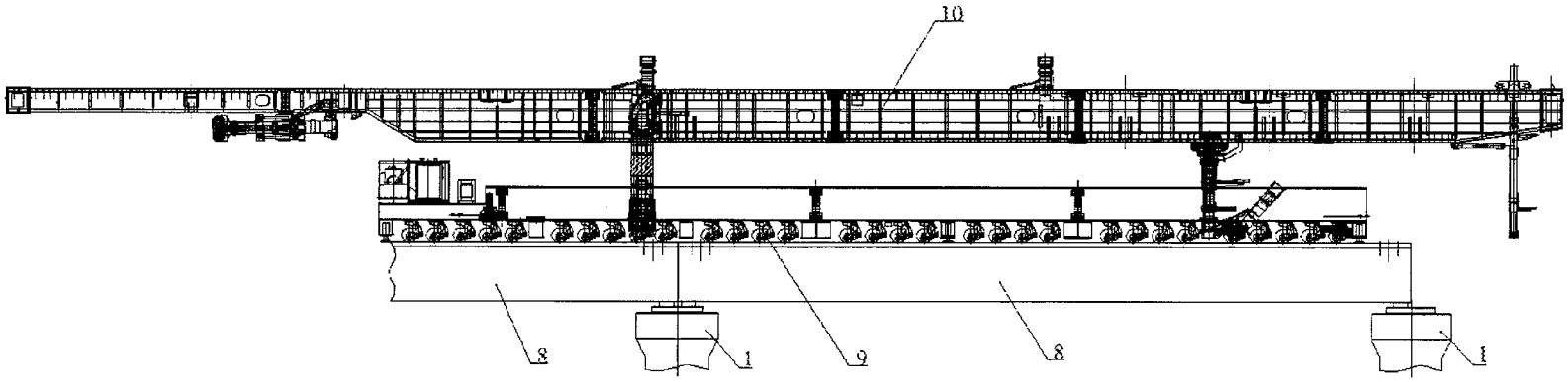
FIG. 10 is a schematic view of transporting by the girder transport vehicle the bridge erecting machine to the front for operation according to the invention.

S3: lifting by the lifter 6 the transport and erection apparatus to the bridge;

S31: transporting by the girder transport vehicle 9 the bridge erecting machine 10 to the lifting station 2, wherein the center line of the girder transport vehicle 9 is adjusted by using a slanted traveling function of the girder transport vehicle 9, so that the center line of the girder transport vehicle 9 and the center line of the bridge line substantially coincide, as shown in FIG. 7;

S32: respectively lifting by the lifter 6 the bridge erecting machine 10 and the girder transport vehicle 9 to the bridge, and placing them on the erected box girder 8 in the step S2, as shown in FIGS. 8 and 9; next, transporting by the girder transport vehicle 9 the bridge girder erecting machine 10 to the front for operation, as shown in FIG. 10.

Figure 11:
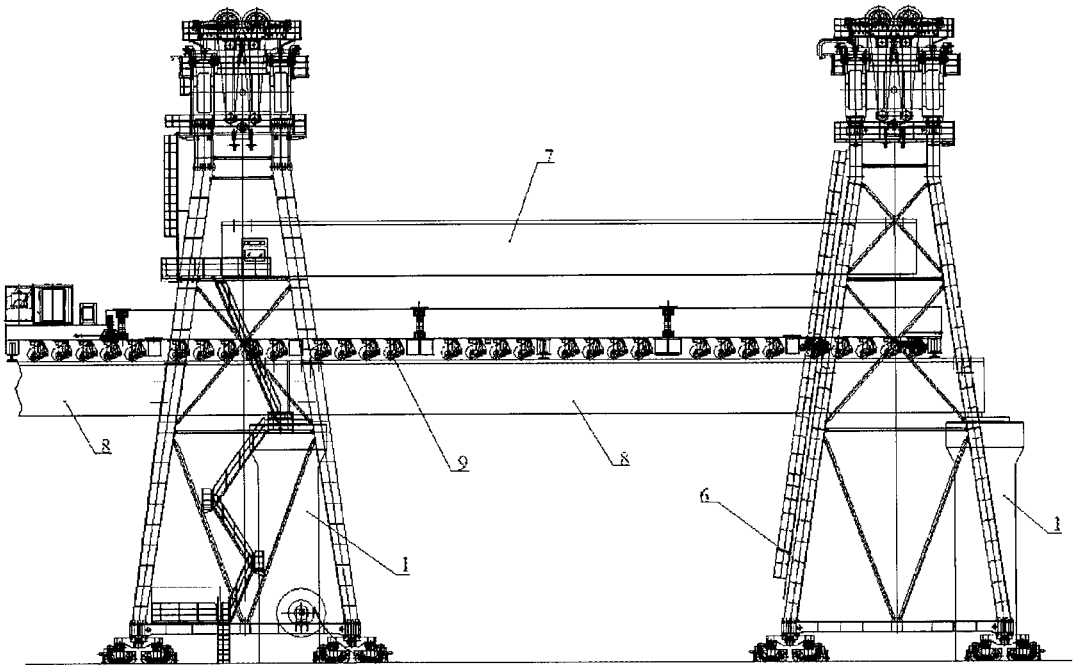
FIG. 11 is a schematic view of placing by the lifter the box girder to be erected on the girder transport vehicle according to the invention.

S4: lifting by the lifter 6 the box girder to the bridge;

S41: transporting by a transporter the box girder 7 to be erected to the girder lifting base 3 for storage, as shown in FIG. 3;

S42: causing the lifter 6 to travel directly above the girder lifting base 3 and lifting the box girder 7 to be erected to the height of the vehicle loading;

S43: longitudinally moving the lifter 6 to be directly above the girder transport vehicle, and placing the box girder 7 to be erected on the girder transport vehicle 9, as shown in FIG. 11.

Embodiment 3

Figure 12:
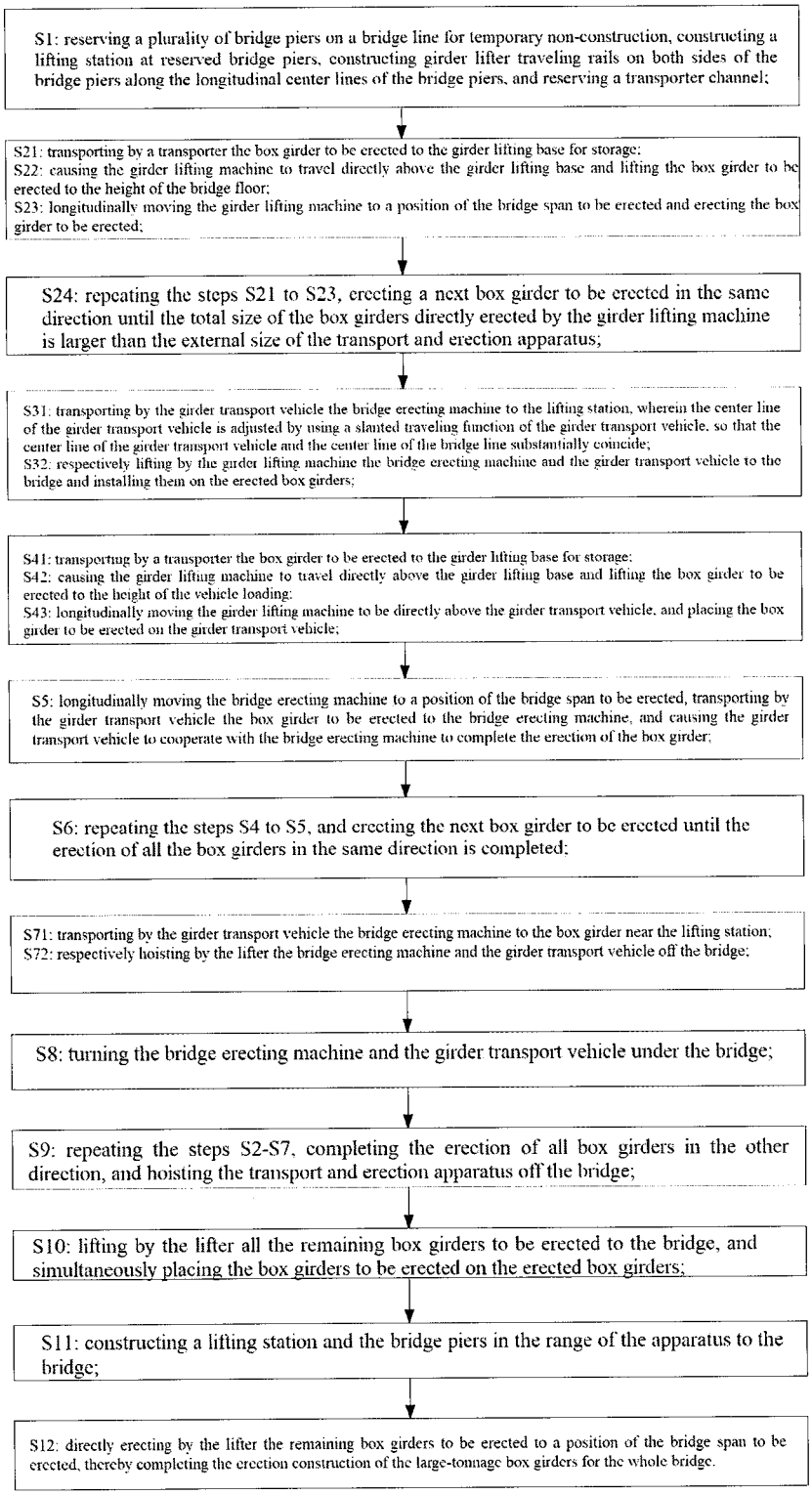
FIG. 12 is a schematic view illustrating an erection method for a large-tonnage box girder according to Embodiment 3 of the invention.
Figure 13:
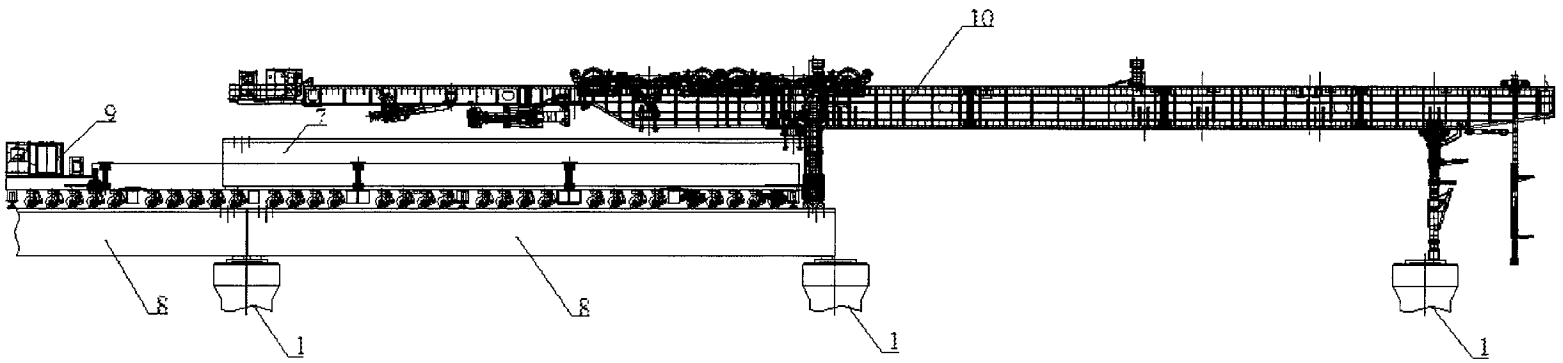
FIG. 13 is a schematic view of transporting by the girder transport vehicle the box girder to be erected to the front for operation according to the invention.

As shown in FIG. 12, an erection method for a large-tonnage box girder comprises the steps S1-S4 of the embodiment 2, and further comprises:

S5: causing the girder transport vehicle 9 to cooperate with the bridge erecting machine 10 to complete the erection of the box girder;

longitudinally moving the bridge erecting machine 10 to a position of the bridge span to be erected, transporting by the girder transport vehicle 9 the box girder to be erected to the bridge erecting machine 10, and causing the girder transport vehicle 9 to cooperate with the bridge erecting machine 10 to complete the erection of the box girder, as shown in FIG. 13;

S6: repeating the steps S4 to S5, and erecting the next box girder to be erected until the erection of all the box girders in the same direction is completed;

S7: hoisting by the lifter the transport and erection apparatus off the bridge;

S71: transporting by the girder transport vehicle the bridge erecting machine to the box girder near the lifting station;

S72: respectively hoisting by the lifter the bridge erecting machine and the girder transport vehicle off the bridge;

S8: turning the bridge erecting machine and the girder transport vehicle under the bridge;

S9: repeating the steps S2-S7, completing the erection of all box girders in the other direction, and hoisting the transport and erection apparatus off the bridge;

S10: lifting by the lifter the remaining box girders to be erected (the box girders to be erected in the range of the reserved bridge piers) to the bridge, and simultaneously placing the box girders to be erected on the erected box girders;

S11: constructing the reserved bridge piers;

S12: directly erecting by the lifter the remaining box girders to be erected (the box girders to be erected within the range of the reserved bridge piers) to the bridge span position to a position of the bridge span to be erected, thereby completing the erection construction of the large-tonnage box girders for the whole bridge.

Embodiment 4

Figure 14:
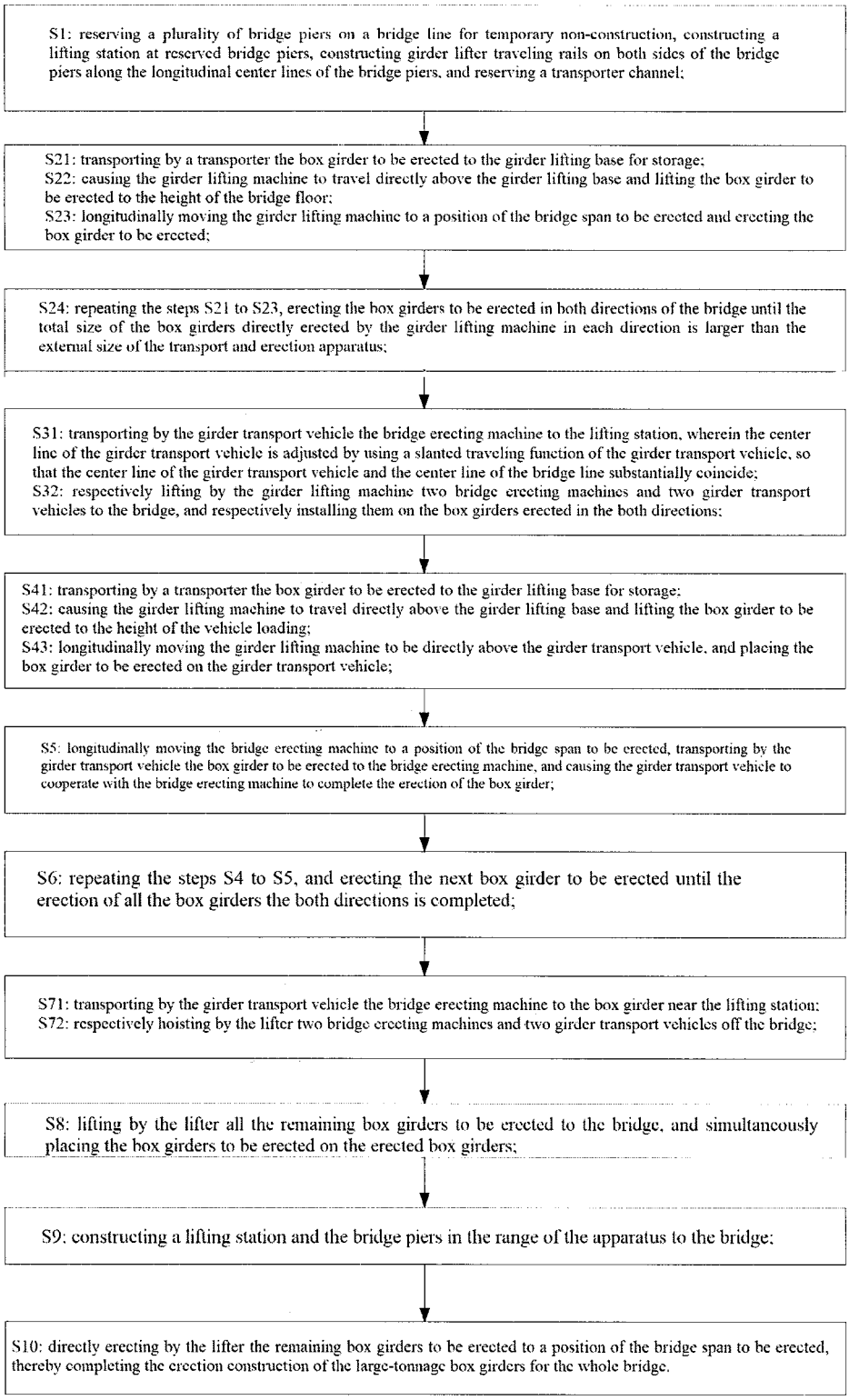
FIG. 14 is a schematic view illustrating an erection method for a large-tonnage box girder according to Embodiment 4 of the invention.

As shown in FIG. 14, an erection method for a large-tonnage box girder comprises:

S1: Constructing a Lifting Station 2;

As shown in FIG. 2, a plurality of bridge piers 1 are reserved on a bridge line for temporary non-construction, a lifting station 2 is constructed at the reserved bridge piers 1, and the center line of the span of the lifting station 2 coincides with the center line of M-shaped bridge piers 1. A plurality of girder lifting bases 3 are arranged in the lifting station 2, and the girder lifting bases 3 are arranged in the middle of the lifting station 2 and are positioned right below the bridge line. An lifter traveling rail 4 is constructed on both sides of the bridge pier 1 along the longitudinal center line of the bridge pier 1, the coverage range of the lifter traveling rail 4 at least comprises three front and rear bridges of the lifting station 2, and an lifter is installed on the lifter traveling rail 4. A transporter channel 5 is reserved and constructed near the lifting station 2 for the transporter to travel.

S2: directly erecting a box girder by the lifter 6;

S21: transporting by a transporter the box girder 7 to be erected to the girder lifting base 3 for storage, as shown in FIG. 3;

S22: causing the lifter 6 to travel directly above the girder lifting base 3 and lifting the box girder 7 to be erected to the height of the bridge floor, as shown in FIG. 4;

S23: longitudinally moving the lifter 6 to a position of the bridge span to be erected and erecting the box girder 7 to be erected, as shown in FIG. 5;

S24: repeating the steps S21 to S23, erecting the box girder 7 to be erected in both directions of the bridge, completing erection work of a plurality of box girders on both sides of the lifting station 2 until the total size of the box girders directly erected by the lifter 6 in each direction is larger than the external size of the transport and erection apparatus, wherein the external size of the transport and erection apparatus comprises the length and the width of the bridge erecting machine and the girder transport vehicle.

S3: lifting by the lifter 6 two sets of transport and erection apparatuses to the bridge;

S31: transporting by the girder transport vehicle 9 the bridge erecting machine 10 to the lifting station 2, wherein the center line of the girder transport vehicle 9 is adjusted by using a slanted traveling function of the girder transport vehicle 9, so that the center line of the girder transport vehicle 9 and the center line of the bridge line substantially coincide, as shown in FIG. 7;

S32: respectively lifting by the lifter 6 the bridge erecting machine 10 and the girder transport vehicle 9 to the bridge, and placing them on the erected box girder 8 in the step S2, as shown in FIGS. 8 and 9; next, transporting by the girder transport vehicle 9 the bridge girder erecting machine 10 to the front for operation, as shown in FIG. 10. In this step, the lifter 6 lifts two sets of transport and erection apparatuses to the erected box girders 8 in both directions.

S4: lifting by the lifter 6 the box girder to the bridge;

S41: transporting by a transporter the box girder 7 to be erected to the girder lifting base 3 for storage, as shown in FIG. 3;

S42: causing the lifter 6 to travel directly above the girder lifting base 3 and lifting the box girder 7 to be erected to the height of the vehicle loading;

S43: longitudinally moving the lifter 6 to be directly above the girder transport vehicle, and placing the box girder 7 to be erected on two girder transport vehicle 9 in different directions, as shown in FIG. 11;

S5: causing the girder transport vehicle 9 to cooperate with the bridge erecting machine 10 to complete the erection of the box girder;

longitudinally moving the bridge erecting machine 10 to a position of the bridge span to be erected, transporting by the girder transport vehicle 9 the box girder 1 to be erected to the bridge erecting machine 10, and causing the girder transport vehicle 9 to cooperate with the bridge erecting machine 10 to complete the erection of the box girder, as shown in FIG. 13; in the step, the girder transport vehicle 9 in each direction cooperates with the bridge erecting machine 10 to complete box girder erection, and box girder erection in both directions of the bridge is completed;

S6: repeating the steps S4 to S5, and erecting the next box girder to be erected until the erection of all the box girders in the both directions is completed;

S7: hoisting by the lifter two sets of the transport and erection apparatuses off the bridge;

S71: transporting by the girder transport vehicle the bridge erecting machine to the box girder near the lifting station;

S72: respectively hoisting by the lifter the bridge erecting machine and the girder transport vehicle off the bridge;

S8: lifting by the lifter the remaining box girders to be erected (the box girders to be erected in the range of the reserved bridge piers) to the bridge, and simultaneously placing the box girders to be erected on the erected box girders;

S9: constructing the reserved bridge piers;

S10: directly erecting by the lifter the remaining box girders to be erected (the box girders to be erected within the range of the reserved bridge piers) to the bridge span position to a position of the bridge span to be erected, thereby completing the erection construction of the large-tonnage box girders for the whole bridge.

The above embodiments are used only to describe the invention and do not limit the technical solutions described in the invention. Although the present invention has been described in detail with reference to the above-described embodiments, the present invention is not limited to the above-described embodiments, and thus any modifications or equivalent substitutions may be made thereto; and all changes and modifications that do not depart from the spirit and scope of the invention are intended to be covered by the following claims.

The invention claimed is:

1. A construction method for a large-tonnage box girder, comprising the following steps:

S1: constructing a lifting station;

reserving a plurality of bridge piers on a bridge line for temporary non-construction, constructing a lifting station at reserved bridge piers, arranging a plurality of girder lifting bases in the lifting station, and constructing lifter traveling rails and installing lifters on both sides of the bridge piers along the longitudinal center lines of the bridge piers;

S2: directly erecting a box girder by the lifter;

S21: transporting a box girder to be erected to the girder lifting base for storage;

S22: causing the lifter to travel directly above the girder lifting base and lifting the box girder to be erected to the height of the bridge floor;

S23: longitudinally moving the lifter to a position of the bridge span to be erected and erecting the box girder to be erected;

S24: repeating the steps S21 to S23, erecting a next box girder to be erected until the total size of the box girders directly erected by the lifter is larger than the external size of the transport and erection apparatus;

S3: lifting by the lifter the transport and erection apparatus to the bridge;

S31: transporting by a girder transport vehicle a bridge erecting machine to a lifting station;

S32: respectively lifting by the lifter the bridge erecting machine and the girder transport vehicle to the bridge, and placing the box girder erected in the step S2;

S4: lifting by the lifter the box girder to the bridge;

S41: transporting by a transporter the box girder to be erected to the girder lifting base for storage;

S42: causing the lifter to travel directly above the girder lifting base and lifting the box girder to be erected to the height of the vehicle loading;

S43: longitudinally moving the lifter to be directly above the girder transport vehicle, and placing the box girder to be erected on the girder transport vehicle;

S5: causing the girder transport vehicle to cooperate with the bridge erecting machine to complete the erection of the box girder;

longitudinally moving the bridge erecting machine to a position of the bridge span to be erected, transporting by the girder transport vehicle the box girder to be erected to the bridge erecting machine, and causing the girder transport vehicle to cooperate with the bridge erecting machine to complete the erection of the box girder;

S6: repeating the steps S4 to S5, and erecting the next box girder to be erected until the erection of all the box girders in the same direction is completed;

S7: hoisting by the lifter the transport and erection apparatus off the bridge;

S71: transporting by the girder transport vehicle the bridge erecting machine to the box girder near the lifting station;

S72: respectively hoisting by the lifter the bridge erecting machine and the girder transport vehicle off the bridge;

S8: turning the bridge erecting machine and the girder transport vehicle under the bridge;

S9: repeating the steps S2-S7, completing the erection of all box girders in the other direction, and hoisting the transport and erection apparatus off the bridge;

S10: lifting by the lifter all the box girders to be erected in the range of the reserved bridge piers to the bridge, and simultaneously placing the box girders to be erected on the erected box girders;

S11: constructing the reserved bridge piers;

S12: directly erecting by the lifter the box girders to be erected within the range of the reserved bridge piers to a position of the bridge span to be erected, thereby completing the erection construction of the large-tonnage box girders for the whole bridge.

2. The method according to claim 1, wherein:

in the step S2, erecting by the lifter the box girders in both directions of the bridge, wherein a plurality of box girders are arranged on both sides of the lifting station, and the total size of the box girders directly erected by the lifter in each direction is larger than the external size of the transport and erection apparatus;

in the step S3, lifting by the lifter two sets of transport and erection apparatuses to the box girders in both directions;

in the step S4, respectively placing the box girders lifted by the lifter on two girder transport vehicles in different directions;

in the step S5, causing the girder transport vehicle in each direction to cooperate with the corresponding bridge erecting machine to complete box girder erection;

in the step S6, repeating the steps S4 to S5, and erecting the next box girder to be erected until the erection of all the box girders in the both directions is completed; and in the step S7, hoisting by the two sets of transport and erection apparatuses off the bridge, wherein the steps S8 and S9 are omitted.

* * * * *